US007065878B2

(12) United States Patent
Uchiyama

(10) Patent No.: US 7,065,878 B2
(45) Date of Patent: Jun. 27, 2006

(54) ROTARY TYPE ELECTRIC SHAVER

(75) Inventor: Hiromi Uchiyama, Matsumoto (JP)

(73) Assignee: Izumi Products Company, Nagano (JP)

( * ) Notice: Subject to any disclaimer, the term of this patent is extended or adjusted under 35 U.S.C. 154(b) by 0 days.

(21) Appl. No.: 10/786,750

(22) Filed: Feb. 25, 2004

(65) Prior Publication Data

US 2004/0163259 A1 Aug. 26, 2004

(30) Foreign Application Priority Data

Feb. 26, 2003 (JP) ..... 2003-048448

(51) Int. Cl.
*B26B 19/04* (2006.01)

(52) U.S. Cl. ..... 30/43.6; 30/346.51

(58) Field of Classification Search ..... 30/43.6, 30/346.51, 43.47, 43.8, 43.5, 43.4
See application file for complete search history.

(56) References Cited

U.S. PATENT DOCUMENTS

| | | | | |
|---|---|---|---|---|
| 2,253,016 | A * | 8/1941 | Collins | 30/43.6 |
| 2,315,274 | A * | 3/1943 | Rand, Jr. | 30/43.6 |
| 2,359,880 | A * | 10/1944 | Scully | 30/43.2 |
| 2,518,181 | A * | 8/1950 | Renne | 30/43.6 |
| 3,116,551 | A * | 1/1964 | Anton | 30/43.6 |
| 3,220,108 | A * | 11/1965 | MacCarthy | 30/34.2 |
| 4,707,923 | A * | 11/1987 | Tietjens | 30/346.51 |

FOREIGN PATENT DOCUMENTS

| | | |
|---|---|---|
| EP | 52-116360 | 9/1977 |
| WO | WO 95/29042 | 1/1995 |

* cited by examiner

*Primary Examiner*—Allan N. Shoap
*Assistant Examiner*—Omar Flores Sánchez
(74) *Attorney, Agent, or Firm*—Koda & Androlia

(57) ABSTRACT

A rotary type electric shaver including an outer cutter and an inner cutter which is rotationally driven while making sliding contact with the interior surface of the outer cutter, wherein and the gap between the outer circumferential side surface of the outer cutter and the rotating side surface of the inner cutter varies in circumferential positions of the outer cutter, so that the gap between the outer circumferential side surface of the outer cutter and the rotating side surface of the inner cutter varies from wide portion to narrow portion.

3 Claims, 5 Drawing Sheets

ROTARY TYPE ELECTRIC SHAVER

BACKGROUND OF THE INVENTION

1. Field of the Invention

The present invention relates to a rotary type electric shaver and more particularly to installation positions of an outer cutter and an inner cutter of an electric rotary shaver.

2. Prior Art

FIG. 7 shows an outer cutter unit in a conventional rotary type electric shaver.

The rotary type electric shaver of FIG. 7 is a so-called three-headed electric shaver. In this shaver, three outer cutters 10 each in a circular ring shape are disposed in an outer cutter frame 12, and the centers of three outer cutters are arranged so as to coincide with the vertices of an equilateral triangle. Slit holes 11 for the introduction of hair are formed in the outer cutters 10; and numerous number of such slit holes 11 are oriented in the circumferential direction of each of the outer cutters 10.

FIG. 8 shows the internal construction of the outer cutter unit that includes the outer cutter 10. In FIG. 8, only one outer cutter is shown. The outer cutter 10 is formed in a shape of a cap, the cutting portion 10*a* that comes into contact with the skin is flat, and slit holes 11 are formed through this cutting portion 10*a*.

Each inner cutter 20 includes a plurality of inner cutter blades 21 that are formed in an upright position around the circumference of an inner cutter blade supporting body 22 which is in the shape of a circular disk. The tip end portions of the inner cutter blades 21 that make sliding contact with the interior surface of the corresponding cutting portion 10*a* of the outer cutter 10 constitute cutters that cut hair.

The inner cutter blade supporting body 22 is provided at its center with an engaging hole 24 that engages with a drive shaft which is rotationally driven by a driving motor installed in the main body of the electric shaver. As a result of the drive shaft engaging with this engaging hole 24, the inner cutter 20 is rotationally driven as a unit with the drive shaft and acts in conjunction with the outer cutter 10 to cut hair introduced into the interior of the outer cutter 10 via the slit holes 11.

As described above, in a rotary type electric shaver, shaving is accomplished by causing the inner cutter 20 to rotate interior of the outer cutter 10 so that hair introduced into the outer cutter 10 is cut by the inner cutter 20 and outer cutter 10. Accordingly, in conventional rotary type electric shavers, the center of the outer cutter 10 and the center of the inner cutter 20 are coincide, thus being coaxial with each other, and the inner cutter 20 is rotationally driven in a coaxial fashion with the outer cutter 10. In FIG. 8, Ds indicate the separating gaps between the outer circumferential side surface of the outer cutter 10 and the position of the outside surface of the inner cutter 20 (or position of the outside surface of the inner cutter blade 21). In the conventional rotary type electric shavers, since the outer cutter 10 and inner cutter 20 are provided coaxially, this gap D is constant around the entire circumference of the outer cutter 10.

Generally, in rotary type electric shavers, hair introduced into the interior of the outer cutter 10 through the slit holes 11 of the outer cutter 10 is cut by the inner cutter 20 and outer cutter 10. During shaving, the skin enters the interior of the outer cutter via the slit holes 11 of the outer cutter 10, especially via the portions of the slit holes 11 on the outer portion side of the outer cutter 10. Deep shaving is made possible since the skin thus enters into the slit holes 11.

However, if the gap D shown in FIG. 8 is narrow, the skin that enters the outer cutter 10 is injured by the inner cutters 20 (i.e., shaver burn occurs). On the other hand, if the gap D is wide, though there is no problem of the skin being injured by the inner cutter 20, deep shaving becomes impossible.

Furthermore, the amount of protrusion of the skin into the interior of the outer cutter 10 also varies according to the softness of the skin. As a result, in cases where the cheeks are shaved, the skin tends not to enter the slit holes 11, thus making deep shaving difficult, while in cases in which areas where the skin is soft such as the jaw and an area under the jaw are shaved, the skin readily enters the slit holes 11 and is easily injured.

SUMMARY OF THE INVENTION

The present invention solves these problems.

The object of the present invention is to provide a rotary type electric shaver that allows effective shaving of hair with respect to the shaving position even in cases where the softness of the skin varies and that allows deep shaving in required places without injuring the skin.

The above object is accomplished by a unique structure of the present invention for a rotary type electric shaver that includes an outer cutter and an inner cutter which is rotationally driven while making sliding contact with the interior surface of the outer cutter; and in the present invention, the outer and inner cutters are provided so that the (separating) gap between the outer circumferential side surface of the outer cutter and the rotating side surface of the inner cutter varies in circumferential positions of the outer cutter.

In this structure, the outer cutter, in a circular shape when viewed from above, is disposed so that the center of the outer cutter and the rotational center of the inner cutter are offset from each other.

In addition, the rotational center of the inner cutter is provided so as to offset with respect to the center of the outer cutter toward the center of an outer cutter frame in which the outer cutter is installed.

DETAILED DESCRIPTION OF THE INVENTION

Preferred embodiments of the present invention will be described in detail below.

Figure 1:
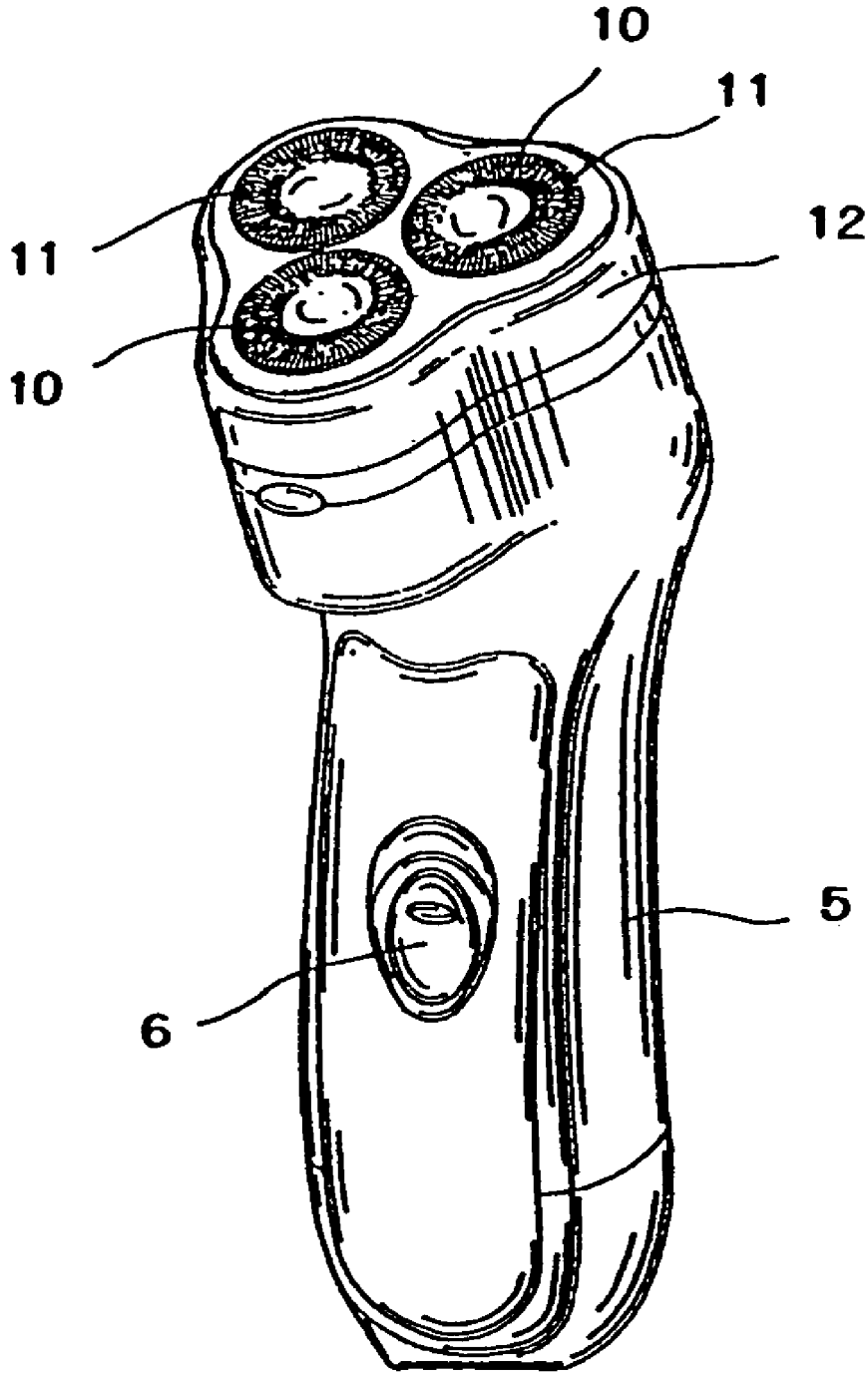
FIG. 1 is a perspective view of the rotary type electric shaver according to the present invention, showing its overall appearance.

FIG. 1 shows the overall construction of one embodiment of the rotary type electric shaver of the present invention. In FIG. 1, the reference numeral 5 refers to the main body of the electric shaver, 12 refers to an outer cutter frame which is detachably attached to the upper part of the main body 5, and 10 refers to outer cutters which are attached to the outer cutter frame 12. An inner cutter is installed interior of each one of the outer cutters 10. The outer cutter frame 12, the outer cutters 10 provided in the outer cutter frame 12, the inner cutters, etc. constitute an outer cutter unit. This outer cutter unit is detachable from the main body 5 of the electric shaver. In FIG. 1, the reference numeral 6 is an ON-OFF switch.

Figure 2:
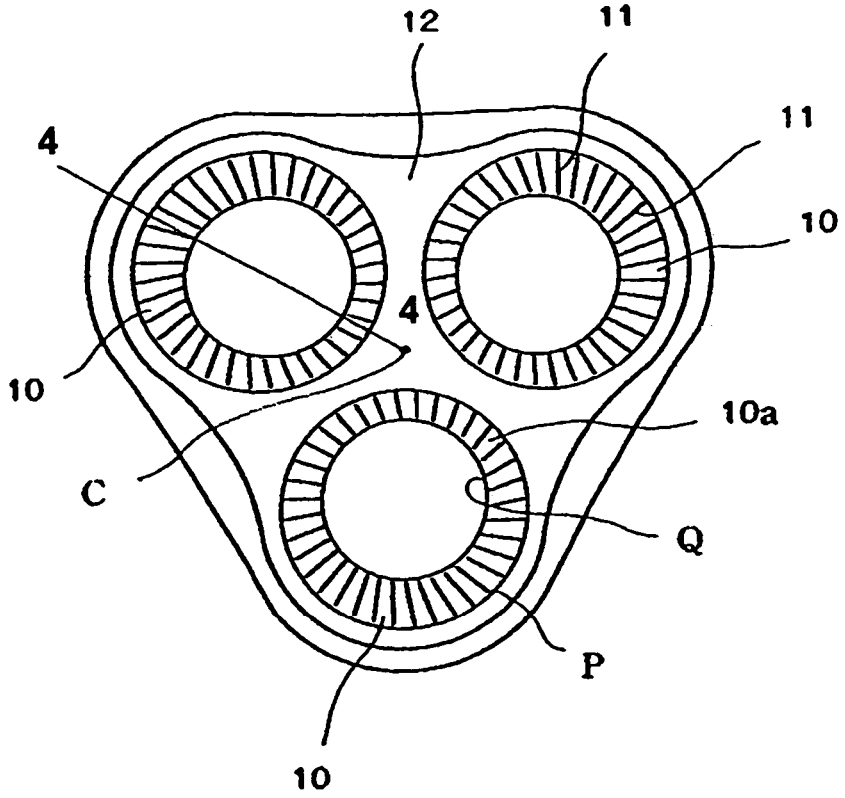
FIG. 2 is a top view of the outer cutter unit of the rotary type electric shaver of the present invention.

FIG. 2 shows the top surface of the outer cutter unit that includes the outer cutters 10. As in a conventional rotary type electric shaver, three outer cutters 10 are respectively disposed in position corresponding to the vertices of an equilateral triangle.

The characterizing feature in the rotary type electric shaver of the present embodiment is that the center of the outer circumferential circle P that runs completely around the outer circumferential of each outer cutter 10 and the rotational center of the corresponding inner cutter that is provided interior of outer cutter 10 are offset.

Figure 3:
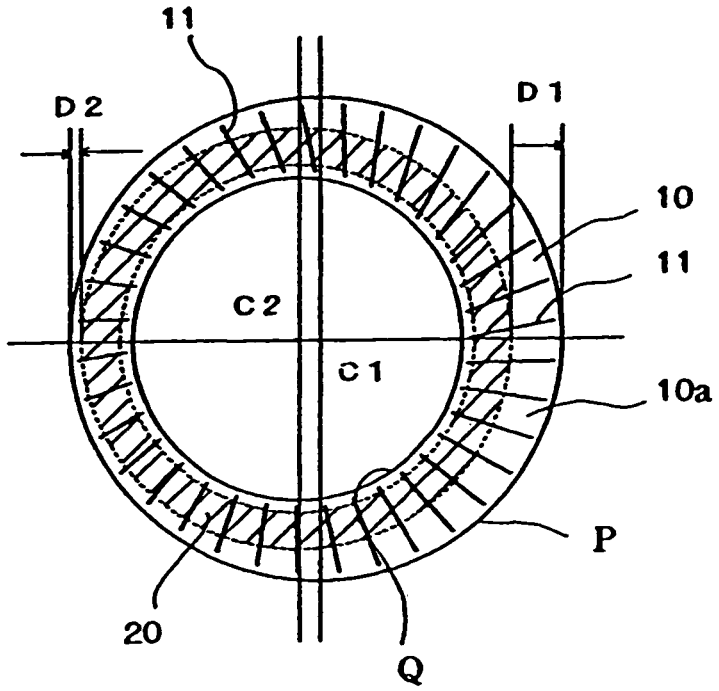
FIG. 3 is an explanatory diagram that shows the relationship between one of the outer cutters and inner cutters in the rotary type electric shaver of the present invention.

More specifically, FIG. 3 shows the outer circumferential circle P of the outer cutter 10, the inner circumferential circle Q that runs completely around the inner circumferential of the outer cutter 10, and the region of rotation of the inner cutter 20 for one of three outer cutters 10. As seen from FIG. 3, since the rotational center C2 of the inner cutter 20 coincides with the center C2 of the of the inner circumferential circle Q of the outer cutter 10, the center C1 of the outer circumferential circle P of the outer cutter and the center of the inner circumferential circle Q are offset with respect to the outer cutter 10.

The direction of eccentricity of the inner circumferential circle Q with respect to the outer circumferential circle P of the outer cutter 10 is selected as desired. In the shown embodiment, as seen from FIG. 2, the inner circumferential circle Q of the outer cutter 10 is offset toward the center C of the three outer cutters 10.

Since the inner circumferential circle Q of the outer cutter 10 is offset with respect to the outer circumferential circle P, the width dimension of the cutting portion 10*a* in which the slit holes 11 are formed is not constant in the circumferential direction but is rather narrower on the central portion side of the outer cutter frame 12 and wider on the outer portion side of the outer cutter frame 12. Since the slit holes 11 (for hair introduction) are formed so as to cut across the cutting portion 10*a*, the length of the slit holes 11 is longer where the cutting portion 10*a* is wide, and the length of the slit holes 11 is shorter where the cutting portion 10*a* is narrow.

Furthermore, the fact that the cutting portion 10*a* is formed so that the width of this cutting portion 10*a* is wider or narrower means that wide portions and narrow portions are generated in the (separating) gap between the sliding contact portions of the inner cutter 20 and outer cutter 10 (i.e., the portions of the inner cutter blades 21 that make a sliding contact with the interior surfaces of the outer cutters 10) and the outer circumferential side surface of the outer cutter 10.

As shown in FIG. 3, in cases where the direction in which the inner circumferential circle Q of the outer cutter 10 is displaced with respect to the outer circumferential circle P of the outer cutter 10 is taken as a reference direction, then the gap or separating gap D2 between the outer circumferential circle P and the passage region of the inner cutter 20 is narrower on the side where the inner circumferential circle Q is in close proximity to the outer circumferential circle P on this reference line, and the separating gap D1 between the outer circumferential circle P and the passage region of the inner cutter 20 is wider on the side where the inner circumferential circle Q is separated from (and is not close proximity to) the outer circumferential circle P.

Figure 4:
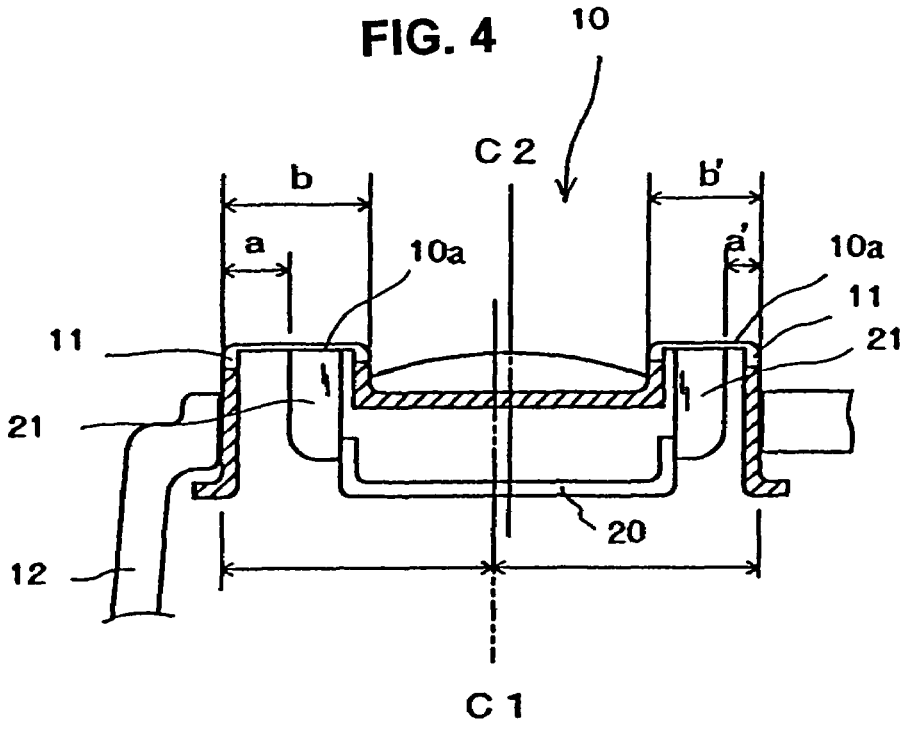
FIG. 4 is an explanatory diagram that shows in cross-section the positional relationship of an outer cutter and inner cutter in the present invention.

FIG. 4 shows, in cross section along line 4—4 in FIG. 2, the above-described outer cutter 10 and inner cutter 20.

In FIG. 4, the reference symbol a indicates the separating gap between the outer circumferential side surface of the outer cutter 10 and the rotating side surface of the inner cutter 20 on the outer portion side of the outer cutter frame 12, and a' indicates the separating gap between the outer circumferential side surface of the outer cutter 10 and the rotating side surface of the inner cutter 20 on the central portion side of the outer cutter frame 12.

As seen from FIG. 4, the separating gap a on the outer portion side of the outer cutter frame 12 is larger than the separating gap a' on the central portion side of the outer cutter frame 12. As further seen from FIG. 4, the width (or the length in the radial direction) b of the cutting portion 10*a* on the outer portion side of the outer cutter frame 12 is greater that the width (or the length in the radial direction) b' of the cutting portion 10*a* on the central portion side of the outer cutter frame 12.

The separating gap (a and a') between the outer circumferential side surface of the outer cutter 10 and the rotating side surface of the inner cutter 20 has a great effect on the closeness of shaving of the rotary type electric shaver.

Figure 5A:
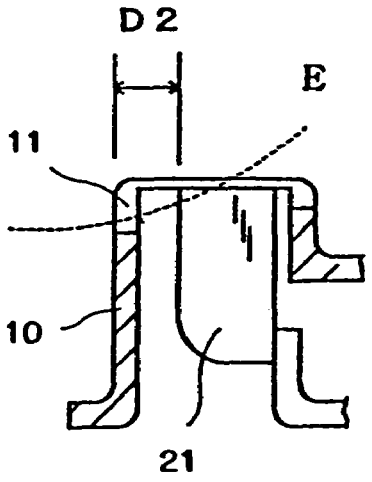
FIGS. 5(*a*) and 5(*b*) are explanatory diagrams showing the positional relationship between the outer cutter and the inner cutter.
Figure 5B:
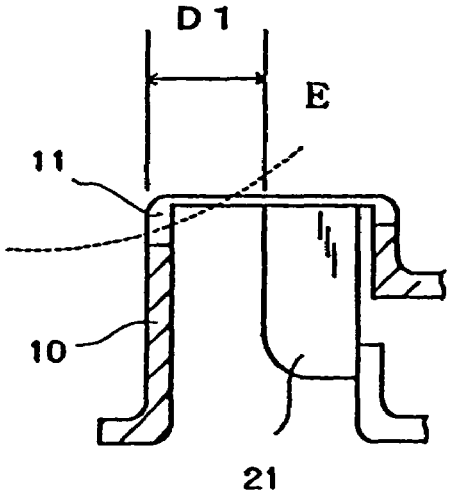

FIGS. 5(*a*) and 5(*b*) show, together with the skin E contacting the outer cutter 10 during shaving, the positional relationship between the outer cutter 10 and the inner cutter 20. FIG. 5(*a*) shows the central portion side of the outer cutter frame 12, and FIG. 5(*b*) shows the outer portion side of the outer cutter frame 12.

When the skin contacts the outer cutter 10 during shaving, the skin protrudes slightly to the interior of the outer cutter 10 via the slit holes 11 formed in the outer cutter 10. The slit holes 11 are, as can be seen from FIGS. 5(*a*) and 5(*b*), formed so as to open from the top surface of the outer cutter 10 to side surfaces of the outer cutter 10; accordingly, when shaving is performed so that the skin contacts the outer circumferential side surface of the outer cutter 10, the skin enters the interior of the outer cutter 10 via such side surface portions of the slit holes 11 that open in the outer circumferential side surface of the outer cutter 10.

Accordingly, in cases where the separating gap between the outer circumferential side surface of the outer cutter 10 and the side surface of the inner cutter 20 (i.e., the side surfaces of the inner cutter blades 21 of the inner cutter 20) is narrow as shown in FIG. 5(*a*), even though the skin protrudes only slightly into the inside of the outer cutter 10, the skin comes into contact with the inner cutter 20. On the other hand, in cases where the separating gap between the outer circumferential side surface of the outer cutter 10 and the side surface of the inner cutter 20 is large or wide as shown FIG. 5(*b*), the skin does not contact the inner cutter 20 even if the skin protrudes into the inside of the outer cutter 10.

The amount of protrusion of the skin into the inside of the outer cutter 10 varies according to the softness of the skin, etc. In the case of the cheeks, etc., the skin tends not to protrude into the inside of the outer cutter 10; while in areas where the skin is soft such as the area under the jaw and the neck area, the skin readily protrudes into the inside of the outer cutter 10. When the skin protrudes into the inside of the outer cutter 10 so that the inner cutter 20 contacts the skin, a burning sensation occurs, and the skin is injured. Accordingly, in such cases, it is advisable to use the portion that has a wide separating gap between the outer cutter 10 and inner cutter 20, so that the skin is not injured. On the other hand, in the case of the cheeks, etc., since the skin tends not to enter the outer cutter 10, it is desirable to use the portion that has a wide separating gap between the outer cutter 10 and inner cutter 20, so that deep shaving is made possible.

In the rotary type electric shaver of the shown embodiment, as seen from FIG. 2, the rotational center of each inner cutter is offset toward the center of the outer cutter frame 12 with respect to the corresponding outer cutter 10. Accordingly, the skin tends not to contact the inner cutter on the outer portion side of the outer cutter frame 12, while the skin and inner cutter are in close proximity to each other on the central portion side of the outer cutter frame 12.

In other words, in the rotary type electric shaver of the shown embodiment, in cases where areas in which the skin is soft such as the area under the jaw or the neck area, etc., are shaved, the shaver is used so that the outer portion side of the outer cutter frame 12 where the separating gap between the outer cutter 10 and the inner cutter is wide (i.e., the corner side of the electric shaver) contacts the skin, thus making it possible to shave without injuring the skin. When the area under the jaw or the neck area is shaved, the corner portion of the outer cutter frame 12 can easily be contacted the skin; accordingly, shaving is facilitated by way of bringing the portion where the separating gap between the outer cutter 10 and inner cutter 20 is wide to contact the skin.

On the other hand, when the cheek areas, etc. are shaved, the shaver is set so that the central portion of the outer cutter frame 12 contacts the skin. When shaving the cheek areas, etc, the outer cutter 10 is brought to make contact with the skin in a flat orientation, the skin and the inner cutter 20 are brought into close proximity to each other, and deep shaving is made possible.

As seen from the above, in the present invention, the rotational centers of the inner cutters 20 are offset with respect to the centers of corresponding outer cutters 10, so that the rotational center of each inner cutter 20 is offset toward the center (or inside) of the outer cutter frame 12 with respect to the corresponding outer cutter 10. Accordingly, shaving without any burning sensation or injury of the skin is accomplished in cases where areas in which the skin is soft are shaved, and deep shaving is made possible in areas where deep shaving is desired. The shaver of the present invention is thus significantly convenient in use.

In conventional rotary type electric shavers, the separating gap between each outer cutter and inner cutter is constant regardless of the position in the circumferential direction of the outer cutter. In the rotary type electric shaver of the present invention, on the other hand, the outer cutters and inner cutters are disposed so that the separating gap between the outer circumferential side surface of each outer cutter and the rotating side surface of the corresponding inner cutter varies according to the circumferential position on the outer cutter. Accordingly, it is possible to shave under appropriate conditions in accordance with the softness of the skin and the shaving position.

In the rotary type electric shaver of the above-described embodiment, the outer circumferential side surface of each of the outer cutters 10 is in a perfectly circular shape. However, the feature of the rotary type electric shaver of the present invention is that the (separating) gap between the outer circumferential side surface of each outer cutter and the rotating side surface of the corresponding inner cutter varies form wide portion to narrow portion. Accordingly, the shape of the outer circumferential side surface(s) of the outer cutter(s) 10 is not limited to a circular shape; and a shape such as an oval shape, egg shape, etc. can be employed for the outer cutters 10.

Furthermore, in the above-described embodiment, all of the three outer cutters 10 are disposed so that the rotational center of the corresponding inner cutter is offset toward the center of the outer cutter frame 12. However, not all the inner cutters are necessarily offset toward the center or inside, and also the direction in which the inner cutters are offset can be selected as desired.

Figure 6:
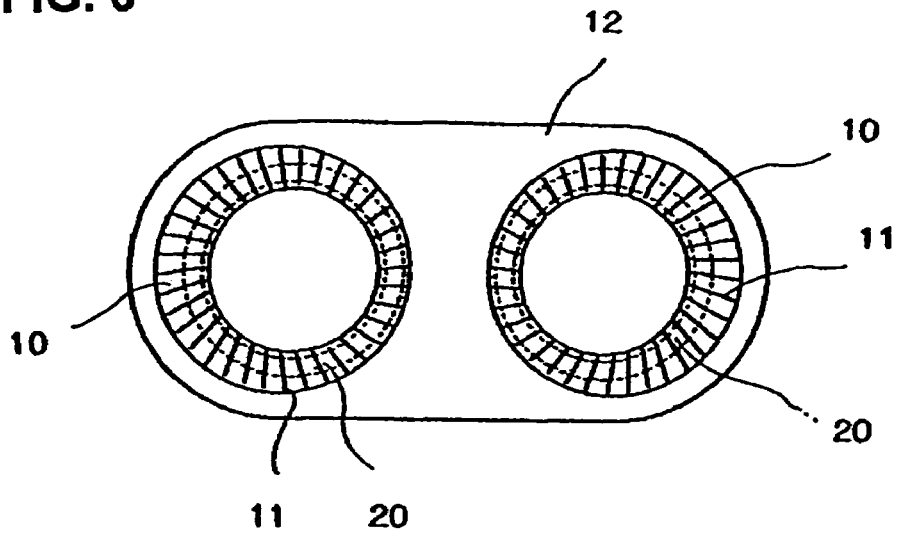
FIG. 6 shows the positional relationship between the outer cutter and the inner cutter in another embodiment of the rotary type electric shaver of the present invention.
Figure 7:
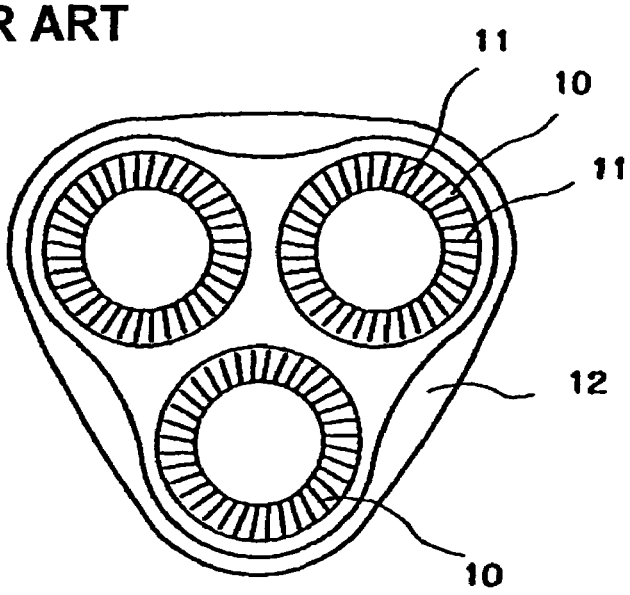
FIG. 7 PRIOR ART
FIG. 7 shows a typical outer cutter arrangement in a conventional rotary type electric shaver.
Figure 8:
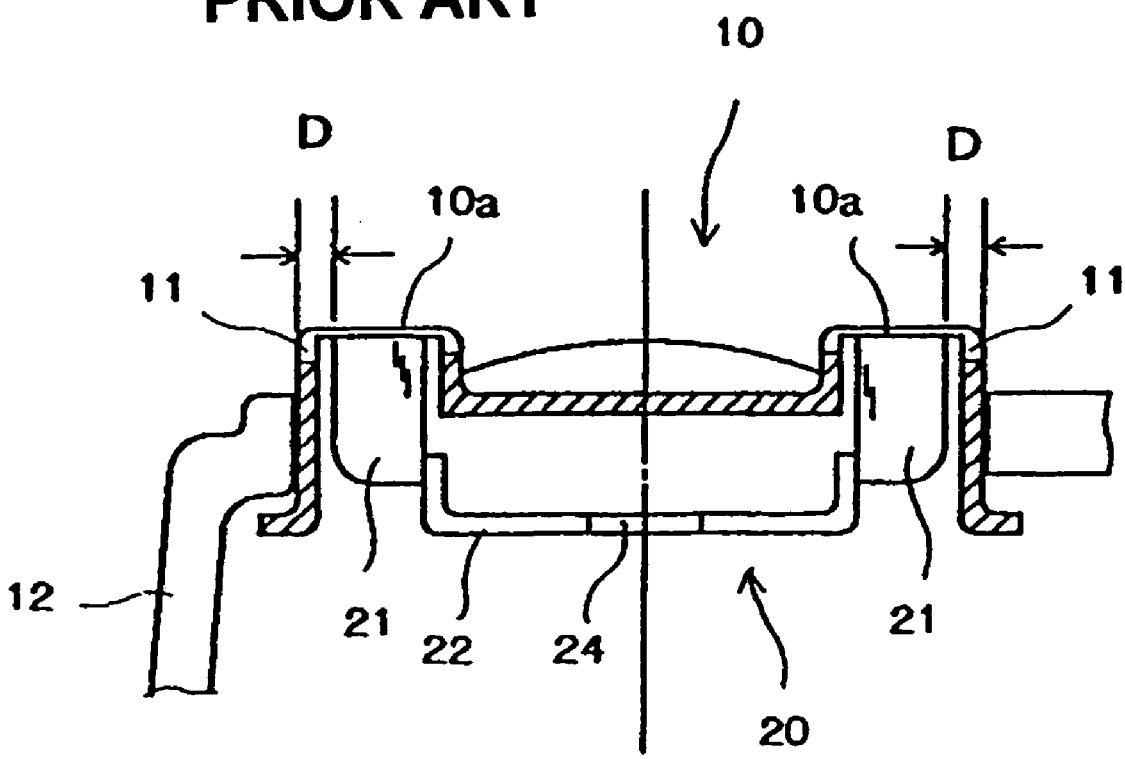
FIG. 8 PRIOR ART
FIG. 8 is an explanatory diagram showing the positional relationship between one of the outer cutters and inner cutters in the conventional rotary type electric shaver.

FIG. 6 shows an embodiment of the rotary type electric shaver of the present invention in which the shaver has two outer cutters 10.

In this embodiment, the rotational centers of the inner cutters 20 mounted in the respective outer cutters 10 are offset toward the center of the outer cutter frame 12 with respect to the centers of the two outer cutters 10. In this rotary type electric shaver having two outer cutters 10 as well, as in the above-described embodiment having thee outer cutters 10, the width of the separating gap between the outer circumferential side surface of the outer cutter and the rotating side surface of the inner cutter is differentiated in the circumferential direction. Accordingly, the position at which the outer cutters 10 contacts the skin during shaving can be adjusted so that shaving that is suited to the softness of the skin and the shaving position is made possible.

As seen from the above, according to the rotary type electric shaver of the present invention, the outer cutter(s) and inner cutter(s) are disposed so that the gap between the outer circumferential side surface of the outer cutter and the rotating side surface of the inner cutter varies according to the positions of the outer cutter in the circumferential direction. Accordingly, shaving burn or injury that would result from the skin contacting the inner cutters during shaving is prevented, and ideal shaving is accomplished in accordance with conditions such as the softness of the skin, etc.

The invention claimed is:

1. A rotary type electric shaver comprising an outer cutter having radially extending hair capturing slits and an inner cutter comprising a plurality of upwardly extending inner cutter blades provided about a circumference of an inner cutter circular support disk, said inner cutter being rotationally driven while making sliding contact with an interior surface of said outer cutter, wherein a gap between an outer circumferential side surface of said interior surface of said outer cutter and a rotating side surface of said inner cutter blades is different in circumferential positions of said outer cutter such that said gap on one side of said inner cutter is fixed and larger than said gap on an opposing side.

2. The rotary type electric shaver according to claim 1, wherein said outer cutter is in a circular shape and is disposed so that a center of said outer cutter and a rotational center of said inner cutter are offset and fixed.

3. The rotary type electric shaver according to claim 2, wherein said rotational center of said inner cutter is fixed and offset with respect to said center of said outer cutter toward a center of an outer cutter frame in which said outer cutter is provided.

* * * * *